US006583804B2

(12) United States Patent
Miyazaki

(10) Patent No.: US 6,583,804 B2
(45) Date of Patent: Jun. 24, 2003

(54) COLOR THERMAL PRINTER

(75) Inventor: Takao Miyazaki, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/797,810

(22) Filed: Mar. 5, 2001

(65) Prior Publication Data

US 2001/0019352 A1 Sep. 6, 2001

(30) Foreign Application Priority Data

Mar. 3, 2000 (JP) ..... 2000-059048

(51) Int. Cl.[7] ..... B41J 11/00
(52) U.S. Cl. ..... 347/218
(58) Field of Search ..... 347/218, 220, 347/215, 175, 197, 177, 173; 400/662, 120.02, 120.03, 120.16

(56) References Cited

U.S. PATENT DOCUMENTS 4,358,776 A * 11/1982 Mitsui ..... 346/136
4,734,704 A * 3/1988 Mizutani et al. ..... 346/46
4,780,729 A * 10/1988 Murakami et al. ..... 347/220
4,999,649 A * 3/1991 Saji et al. ..... 101/409
5,537,140 A * 7/1996 Hayashi et al. ..... 347/175
5,711,620 A * 1/1998 Sasaki et al. ..... 347/173
5,724,085 A * 3/1998 Inui et al. ..... 347/175
5,818,494 A 10/1998 Sato ..... 347/173
6,004,052 A * 12/1999 Muranaka ..... 347/105
6,046,756 A * 4/2000 Iga et al. ..... 347/173
6,211,894 B1 * 4/2001 Yamaya et al. ..... 347/191
6,222,575 B1 * 4/2001 Liu et al. ..... 347/217

FOREIGN PATENT DOCUMENTS

JP 8-67020 3/1996 ..... B41J/2/325
JP 8-174876 7/1996 ..... B41J/2/325

* cited by examiner

*Primary Examiner*—Lamson Nguyen
*Assistant Examiner*—K. Feggins
(74) *Attorney, Agent, or Firm*—Sughrue Mion, PLLC

(57) ABSTRACT

A thermal printer has a conveyor roller set and three thermal heads along a feeding passage. In feeding a recording sheet, a pinch roller is deformed by pressing force of a capstan roller. In addition, platen rollers are also deformed by respective thermal heads. The feeding passage is bent to form V-shape at the feeding roller set and respective thermal heads, so the recording sheet is prevented from waving. By bending the feeding passage, the recording sheet is prevented from waving, so deviation in feeding speed is decreased even when the load to the recording sheet is changed. Moreover, since all thermal heads press the recording sheet simultaneously and are retracted to decrease the pressing force gradually after thermal recording, it is possible to decrease deviation in the load to the recording sheet.

12 Claims, 9 Drawing Sheets

COLOR THERMAL PRINTER

BACKGROUND OF THE INVENTION

1. Field of the Invention

The present invention relates to a color thermal printer for recording a full-color image by use of a plurality of thermal heads. More particularly, the present invention relates to a color thermal printer capable of increasing recording speed, decreasing non-recording area and density unevenness caused by deviations in feeding speed.

2. Background Arts

There are various color thermal printers, some examples of which are a direct thermal recording type and a thermal transfer printing type. Any of the types incorporates a thermal head in which a great number of heating elements are arranged in line. A thermosensitive recording sheet (hereinafter referred to as recording sheet) for use in a direct thermal recording type includes cyan, magenta and yellow thermosensitive coloring layers formed on a support in this order listed. In recording, the heating elements are pressed onto the recording sheet and is driven to record respective color image to respective coloring layers, to produce a full-color image. In the thermal transfer type, a color ink sheet of great length is used, in which yellow, magenta and cyan ink areas are formed in cyclic fashion. The ink is thermally transferred to a recording sheet, to produce a full-color image.

In the color thermal printer, there are plural recording types: a three-pass type in which a recording sheet is passed three times under one thermal head; and a one-pass type in which a recording sheet is passed one time under plural thermal heads. The one-pass type has advantages in shorter time required for printing the same image than the three-pass type, so the one-pass type is used to a color thermal printer for business use that is required to print many sheets continuously.

FIG. 10 illustrates a conventional color thermal printer of the one-pass type. A continuous recording sheet 2 is set in the feeder of the printer as a recording sheet roll 3. A feeding roller 4 draws the recording sheet 2 from the recording sheet roll 3 and feeds it toward a feeding passage. There are a plurality of conveyor roller sets 5 in the feeding passage. Between adjacent conveyor roller sets 5, yellow, magenta and cyan thermal heads 6 to 8 are provided to record respective color images to the yellow, magenta and cyan coloring layers. Below the thermal heads 6 to 8, three platen rollers 9 to 11 are provided to support the thermal heads 6 to 8. Two fixation lamps 12 and 13 are provided for fixing the yellow and magenta coloring layers after thermal recording.

The conveyor roller set 5 includes a capstan roller 15 and a pinch roller 16. The capstan roller 15 is rotated by a conveyor motor. The pinch roller 16 is pressed to the capstan roller 15, and rotates subsidiary to the capstan roller 15. The pinch roller 16 is made of a soft and high-frictional material, like a rubber or the like, so as to ensure to feed the recording sheet 2 without slipping. Also, the platen rollers 9 to 11 are made of a soft and high-frictional material like a rubber, so as to ensure to nip the recording sheet 2. Thus, the capstan rollers 15 and the thermal heads 6 to 8 are slightly inserted into the deformed pinch rollers 16 and the platen rollers 9 to 11 respectively.

In the one-pass type, during the recording of the yellow image to the yellow recording layer, the magenta recording thermal head 7 comes in contact with, and presses, the recording sheet 2. Since the recording sheet 2 receives the pressing force from the magenta recording thermal head 7, a load to the recording sheet 2 is rapidly increased. Thus, the feeding speed of the recording sheet 2 decreases, so that density unevenness is likely to occur.

In order to solve the problem, U.S. Pat. No. 5,818,494 (corresponding to JPA 8-67020) discloses a color thermal printer to decrease the load to the recording sheet by changing the pressing force of the thermal head gradually in pressing and releasing the recording sheet. In addition, JPA 8-174876 discloses a color thermal printer to keep the load constant by pressing and releasing three thermal heads simultaneously.

In the conventional one-pass type, conveyor roller set is provided between two adjacent thermal heads. Thus, long feeding passage required for placing plural conveyor roller sets, makes recoding time longer. In the thermal printer of U.S. Pat. No. 5,818,494, since the load to the recording sheet 2 is increased by increasing the pressing force gradually, density unevenness is likely to occur.

In the thermal printer of JPA 8-174186, the cyan thermal head is provided in the position furthest from the recording sheet roll 3, and the yellow thermal head is the nearest. Since print operation begins when the front end of the recording sheet reaches the cyan thermal head, a leader portion of the recording sheet 2 having a length between the yellow and cyan thermal heads is of no use.

Moreover, since surfaces of the pinch rollers 16 are deformed by the capstan rollers 15, the recording sheet 2 is waved near the conveyor roller sets 5. Since the platen rollers 9 to 11 are also deformed, the recording sheet 2 has waved areas. Since these waved areas work as obstacles for feeding, feeding speed changes largely when the load to the recording sheet 2 increases. In addition, it requires much time before the feeding speed comes up to a certain value.

SUMMARY OF THE INVENTION

An object of the invention is to provide a color thermal printer and a color thermal recording method for increasing recording time and decreasing non-recording area.

Another object of the invention is to decrease density unevenness caused by deviation in feeding speed.

To achieve the above objects, a color thermal printer of the present invention includes a feeding passage for guiding a recording material from a roll toward an outside of the printer, feeding means for feeding the recording material in an advancing direction and a recording direction along the feeding passage, a plurality of thermal heads for recording the image to the recording area, a plurality of platens that are disposed opposite to respective thermal heads, and a elastic members for covering surfaces of respective platens. The elastic members are deformed by pressing force of respective thermal heads, so the feeding passage is bent toward the thermal head at positions where the thermal heads presses the platens, so as to form a V-shape.

The feeding means is disposed at a position upstream of the thermal heads and comprised of a capstan roller and a pinch roller for nipping and feeding the recording material. The pinch roller is covered with a elastic material which is deformed by pressing force of said capstan roller, so the feeding passage is bent toward the capstan roller at a position where the capstan roller presses the pinch roller, so as to form a V-shape. By bending the feeding passage, the recording material is kept from being waved, so it is possible to reduce deviation in feeding speed even when the load to the recording material is changed largely.

In the embodiment, the thermal heads includes cyan, magenta and yellow thermal heads arranged in this order listed. When a print command is produced, the recording material is fed in the advancing direction. When the recording material reaches a print start position where a rear end of the recording area passes the yellow thermal heads, the recording material is stopped and the thermal heads press the recording material simultaneously. Afterwards, the recording material is fed back to the recording direction, and the thermal heads are driven to record respective color image. When respective color image is recorded, each thermal head is moved away from the recording material gradually to decrease pressing force gradually, so that deviation in load to the recording material is decreased.

BRIEF DESCRIPTION OF THE DRAWINGS

The above and other objects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE INVENTION

Figure 1:
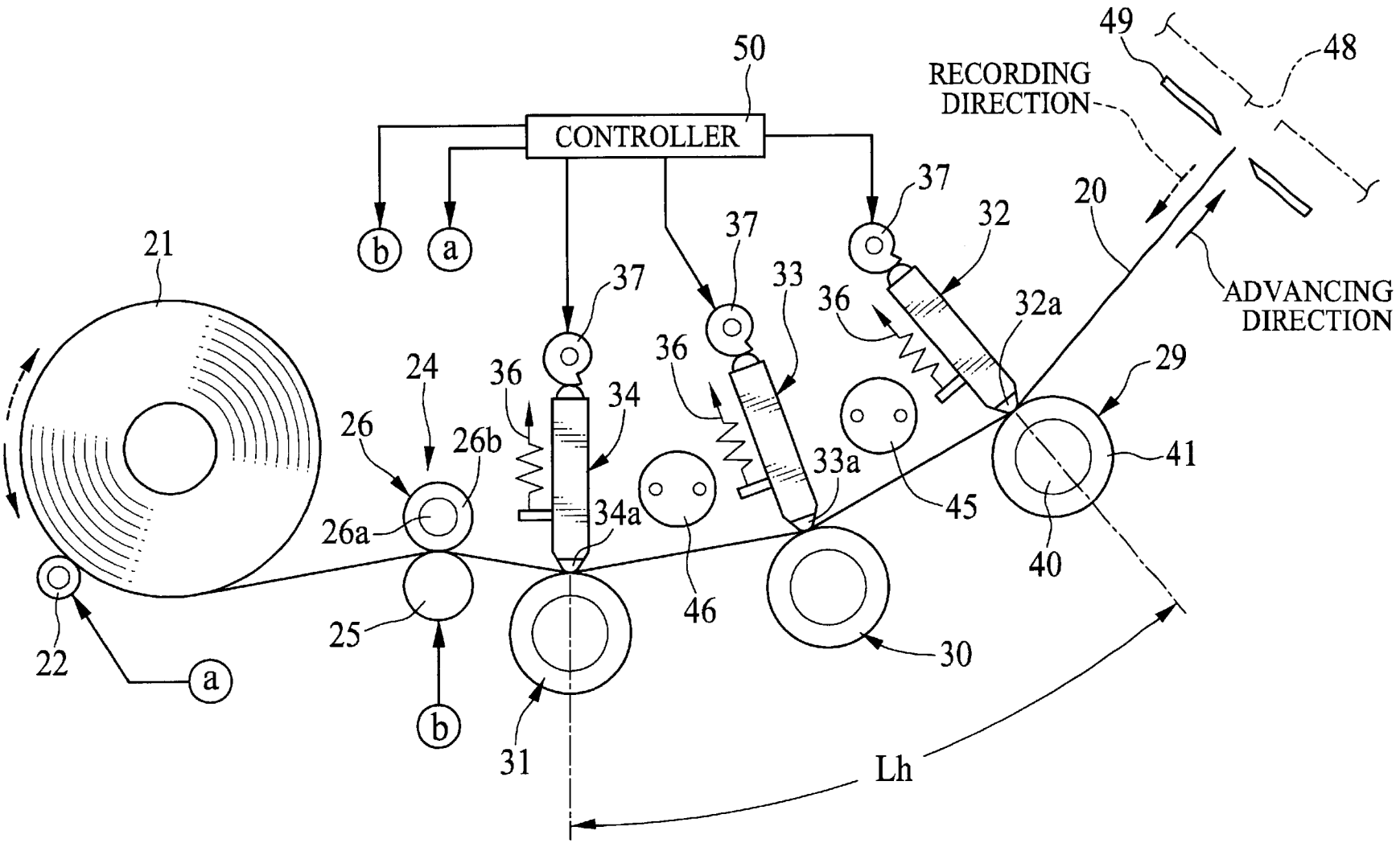
FIG. 1 is a schematic view showing a color thermal printer of the present invention.

FIG. 1 shows a color thermal printer of direct thermal recording type, in which a continuous recording sheet 20 is used as a recording material. The recording sheet 20 is wound to be a recording sheet roll 21, which is set in the printer. A feeding roller 22 contacts to a surface of the recording sheet roll 21. In recording an image, the feeding roller 22 rotates the recording sheet roll 21 to draw the recording sheet 20 into a feeding passage. The feeding passage is formed between an upper guide and a lower guide for guiding the recording sheet 20, but is abbreviated in this figure. After recording, the feeding roller 22 rotates the recording sheet roll 21 to wind the recording sheet 20, to protect against light and humidity.

Figure 2:
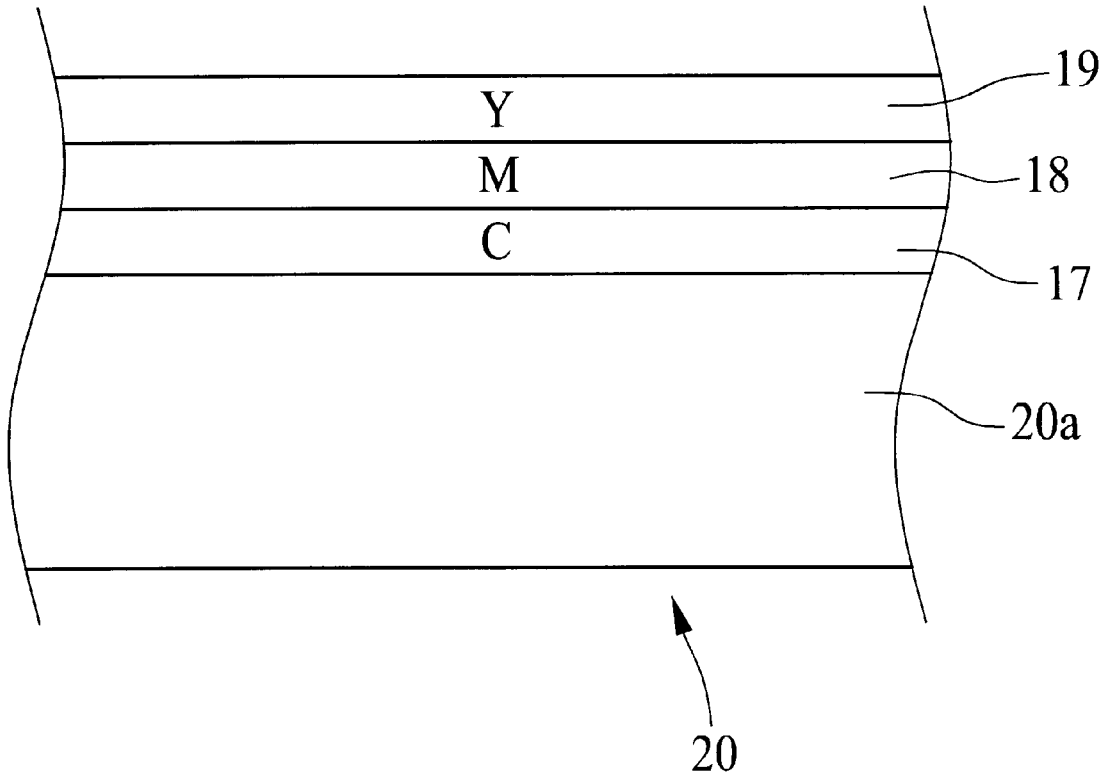
FIG. 2 is a sectional view of the recording sheet.

As shown in FIG. 2, the recording sheet 20 includes a support 20*a* and a cyan thermosensitive coloring layer 17 (cyan coloring layer), a magenta coloring layer 18 (magenta coloring layer) and a yellow coloring layer 19 (yellow coloring layer), which are formed on the support 20*a* in this order listed.

Among those layers, the yellow coloring layer 19 has the highest thermal sensitivity and colors yellow in low thermal energy. The cyan coloring layer 17 has the lowest thermal sensitivity, and is needed highest thermal energy to be colored. The yellow coloring layer 19 has such a characteristic that its coloring ability is destroyed by application of near-ultraviolet rays of 420 nm. The magenta coloring layer 18, formed between the yellow and cyan coloring layers 17 and 19, colors magenta in a thermal energy between the necessary energy for coloring the cyan and yellow coloring layers 17 and 19. In addition, the magenta coloring layer 18 has such a characteristic that its coloring ability is destroyed by application of ultraviolet rays of 365 nm. Four coloring layers may be formed in the recording sheet 20, by forming a black thermosentive coloring layer, for example.

In FIG. 1, in the feeding passage is disposed a conveyor roller set 24, which nips and feeds the recording sheet 20. The conveyor roller set 24 includes a capstan roller 25 and a pinch roller 26. The capstan roller 25 rotates by a conveyor motor. Rotation of the capstan roller 25 is controlled by a controller 50. When the controller 50 rotates the capstan roller 25 in the clockwise direction, the recording sheet 20 is fed in an advancing direction, indicated by a solid arrow. On the other hand, when the controller 50 rotates the capstan roller 25 in the counterclockwise direction, the recording sheet 20 is fed in a recording direction, indicated by a dotted arrow.

The pinch roller 26 usually contacts to the capstan roller 25 by a bias of a spring, and rotates subsidiary to the capstan roller 25. The pinch roller 26 is movable up and down by a cam mechanism or a solenoid. In feeding the recording sheet 20, the pinch roller 26 is retracted from the recording sheet 20 against the bias of the spring. The pinch roller 26 includes a rotation axis 26*a* and roller portion 26*b*. The rotation axis 26*a* is covered with the roller portion 26*b* which is made of a soft and high-frictional material such as a rubber.

Figure 3:
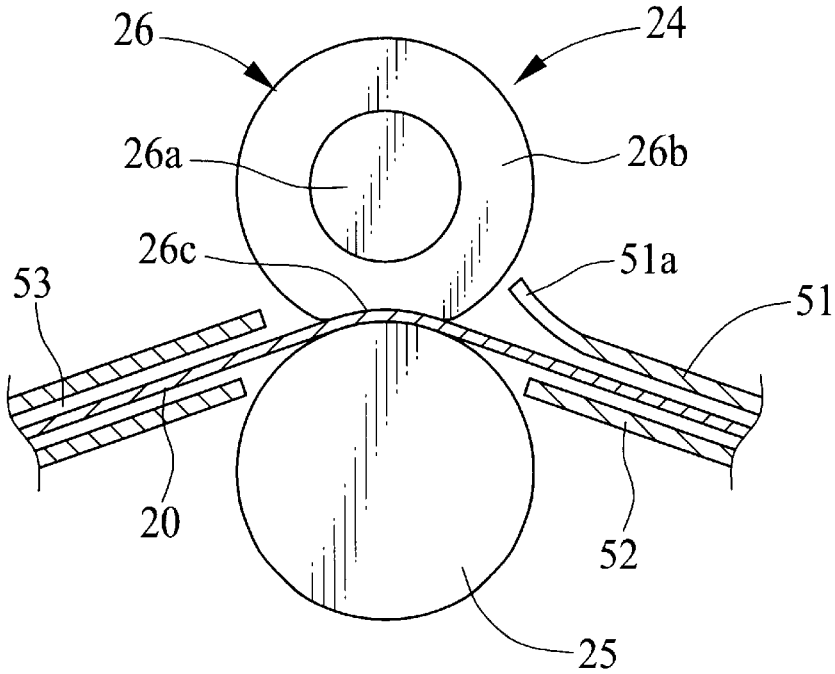
FIG. 3 is an explanatory view of a conveyor roller set which presses the recording sheet.
Figure 10:
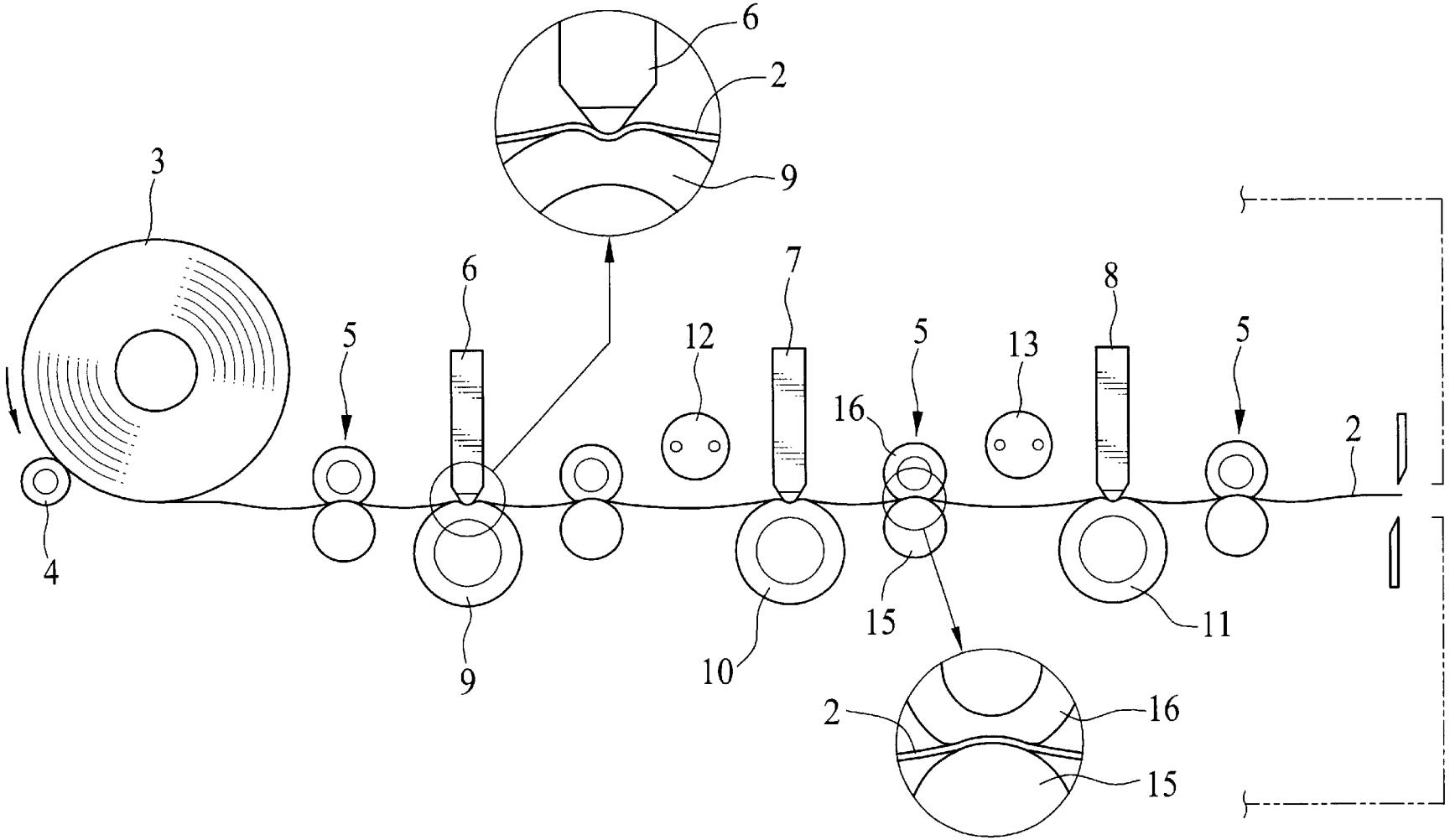
FIG.10 (PRIOR ART)
FIG. 10 is a schematic view showing a conventional color thermal printer.

As shown in FIG. 3, the roller portion 26*b* has a deformed area 26*c* in which the capstan roller 25 presses the pinch roller 26. As mentioned above, there is an upper guide 51 and a lower guide 52, between which a feeding passage 53 is formed to feed the recording sheet 20. At the conveyor roller set 24, the feeding passage 53 is slightly bent toward the pinch roller 26 so as to form a V-shaped portion. The upper guide 51 has a curved portion 51*a* for preventing the advanced recording sheet 20 from going out of the feeding passage 53. Since the recording sheet 20 is fed along the deformed portion 26*c*, the recording sheet 20 is not waved. Thereby, the recording sheet 20 is fed more stably than the conventional thermal printer shown in FIG. 10, so it is possible to decrease deviation in feeding speed.

In FIG. 1, there are three platen rollers 29, 30 and 31 below the passage, which are arranged at regular intervals. Above the platen rollers 29, yellow, magenta and cyan thermal heads 32 to 34 are disposed. Among the three thermal heads 32 to 34, the yellow thermal head 32 is located in a position furthest from the recording sheet roll 21, and the cyan thermal head 34 is the nearest. Bottoms of these thermal heads 32 to 34 have heating element arrays 32*a*, 33*a* and 34*a* respectively. Each of heating element arrays has a plurality of heating elements arranged linearly along the direction perpendicular to the advancing direction. The thermal heads 32 to 34 is movable between recording positions where the heating element arrays 32*a* to 34*a* are pressed onto the recording sheet 20, and retracted positions where the heating element arrays 32*a* to 34*a* are away from the recording sheet 20. In recording, the thermal head 32 to 34, located in the recording positions, drives the heating element arrays 32*a* to 34*a* to record respective color images onto the cyan, magenta and yellow coloring layers 17 to 19.

The movements of the thermal heads 32 to 34 are controlled by head moving mechanisms. The head moving mechanism for yellow includes a head lifting spring 36 and a cam 37. The yellow thermal head 32 is incessantly biased by the head lifting spring 36 toward the retracted position. The head lifting spring 36 keeps the distal end of the yellow thermal head 32 in contact with an edge of the cam 37. The cam 37 is supported in rotatable fashion about a shaft, and is rotated by a motor (not shown). The edge of the cam 37 is so shaped that its radius about the shaft is gradually increased.

When a larger radius portion of the cam 37 is contacted to the yellow thermal head 32, the thermal head 32 is located at the recording position against the bias of the head lifting spring 36. As the cam 37 rotates counterclockwise, the yellow thermal head 32 moves gradually toward the retracted position by the bias of the head lifting spring 36. When a smaller radius portion of the cam 37 is contacted to the yellow thermal head 32, the yellow thermal head 32 is located at the retracted position, and is standing for a recording operation. As the cam rotates 37, the yellow thermal head 32 toward the retracted position, and the force to press the recording sheet 20 is gradually decreased. Thereby, the load to the recording sheet 20 is not rapidly changed when the yellow thermal head 32 moves toward the retracted position, so it is possible to decrease density unevenness or the like.

The head moving mechanisms provided for magenta and cyan thermal heads 33 and 34 have head lifting springs 36 and cams 37 that are the same as those provided for the yellow thermal head 32. Thus, specific description is abbreviated.

The platen roller 29 includes a rotation axis 40 and a roller portion 41. The platen roller 29 is rotatably supported about the rotation axis 40. The roller portion 41 is fit around the rotation axis 40 and is contacted to the recording sheet 20. In order to ensure to press the recording sheet 20, the roller portion 41 is made of a soft and high-frictional material such as a rubber.

Figure 4:
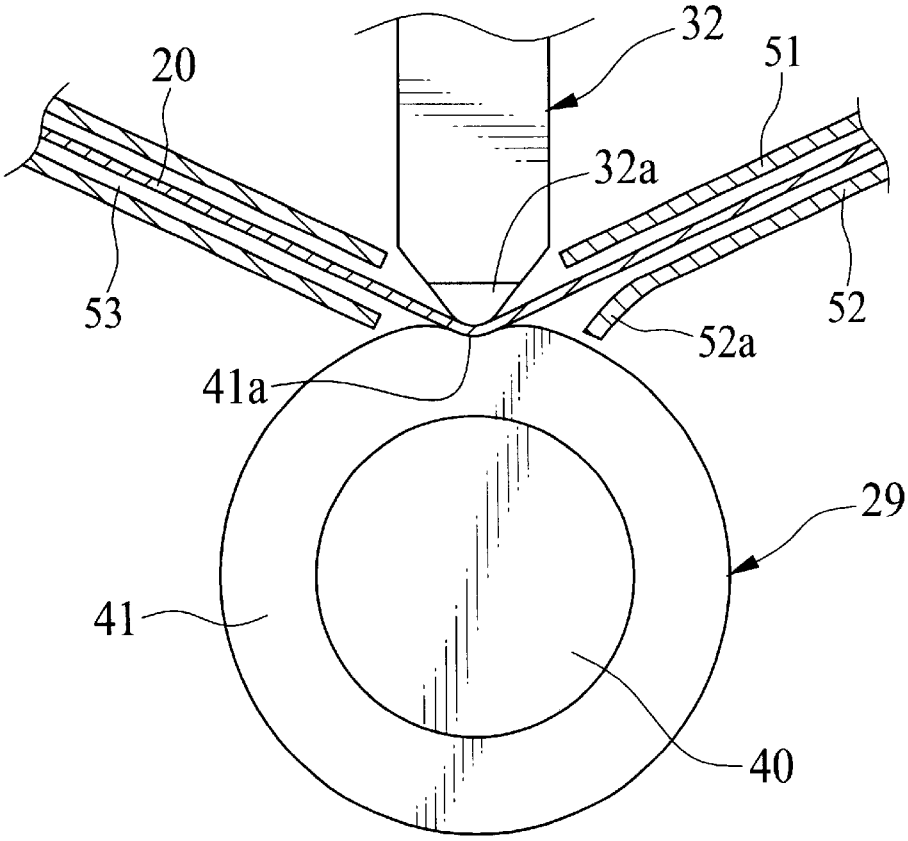
FIG. 4 is an explanatory view of a thermal head and a platen roller which press the recording sheet.

As shown in FIG. 4, the roller portion 41 has a deformed portion 41*a* in which the yellow thermal head 32 presses the platen roller 29. At the platen thermal head 32, the feeding passage 53 is slightly bent toward the platen roller 29 so as to form a V-shaped portion. The lower guide 52 has a curved portion 52*a* for preventing the advanced recording sheet 20 from going out of the feeding passage 53. Since the recording sheet 20 is fed along the deformed portion 41*a*, the recording sheet 20 is not waved. The platen rollers 30 and 31, provided below the magenta and cyan thermal heads 33 and 34, has the same configurations as the platen roller 29.

Figure 5:
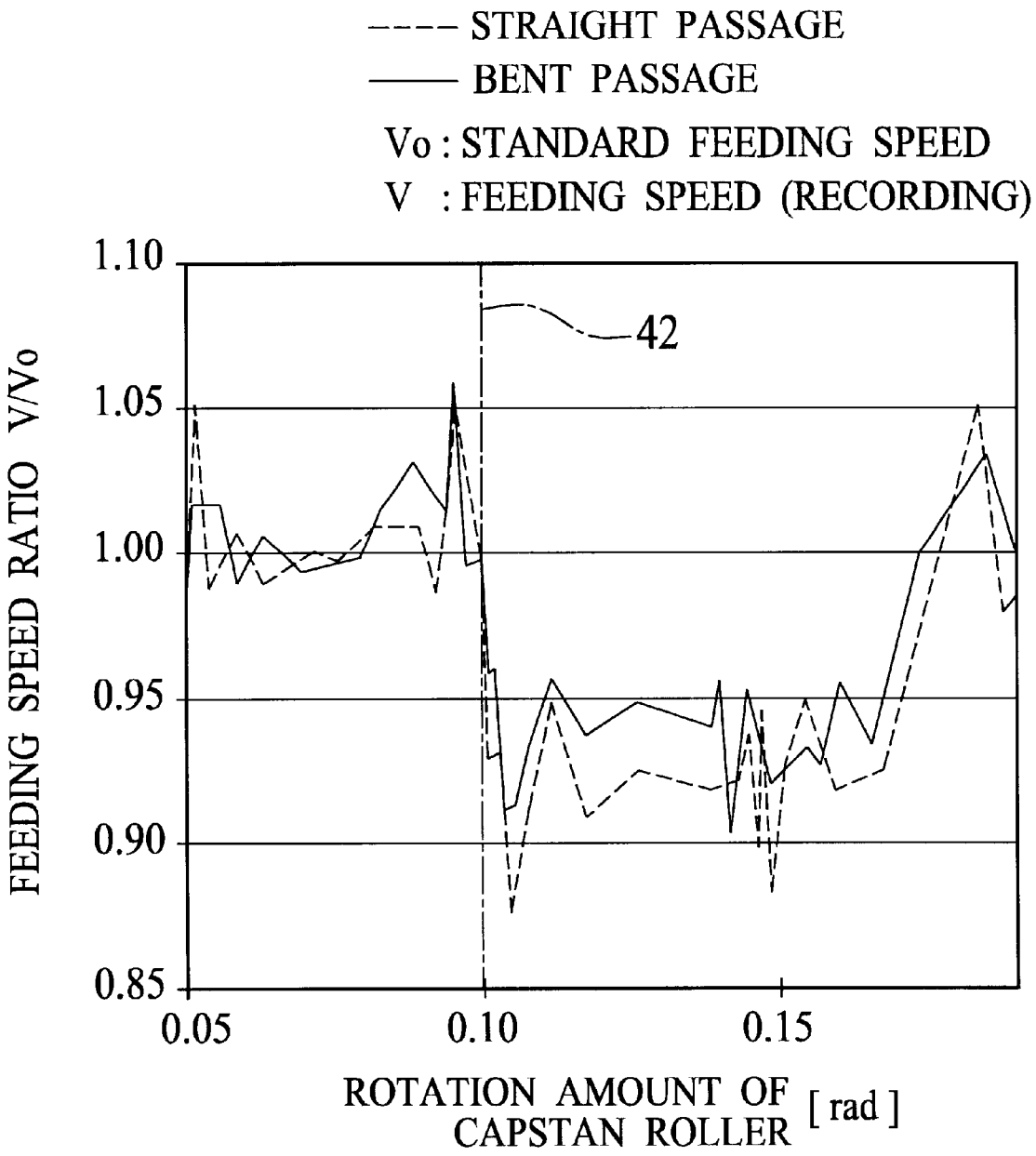
FIG. 5 is a graph showing deviations in feeding speed of the recording sheet according to rotation amount of a capstan roller.

FIG. 5 shows a graph of feeding speed of the leading portion of the recording sheet 20 according to the rotation of the capstan roller 25. In this graph, the vertical axis shows the feeding speed ratio V/Vo, and the horizontal axis shows a rotation amount of the capstan roller 25. The feeding speed ratio V/Vo is defined by the ratio of feeding speed V to standard feeding speed Vo. When the thermal heads 32 to 34 are not driven, the recording sheet 20 is fed at the standard feeding speed Vo without changing the load thereto. In recording, the load to the recording sheet 20 is changed according to the image density, the recording sheet 20 is fed at a changeable feeding speed V.

The ratio V/Vo of the printer with a bent passage (the present invention) is indicated by a solid line, and that with a conventional straight passage is indicated by a dotted line. In this graph, high density recording is carried out before the capstan roller 25 rotates 0.10 rad. Afterwards, low density recording is carried out. The dotted-line 42 indicates the border between the high-density recording state and the low-density recording state. Accordingly, coefficient of friction changes largely when the capstan roller 25 rotates by 0.10 rad, so the load to the recording sheet 20 is changed rapidly at the border 42.

This graph indicates that the printer with bent passage has such a characteristic to decrease the change in feeding speed, compared to the printer with conventional straight passage. Moreover, since deviation in feeding speed is decreased, it is possible to decrease density unevenness and deviation in recording position.

Figure 6:
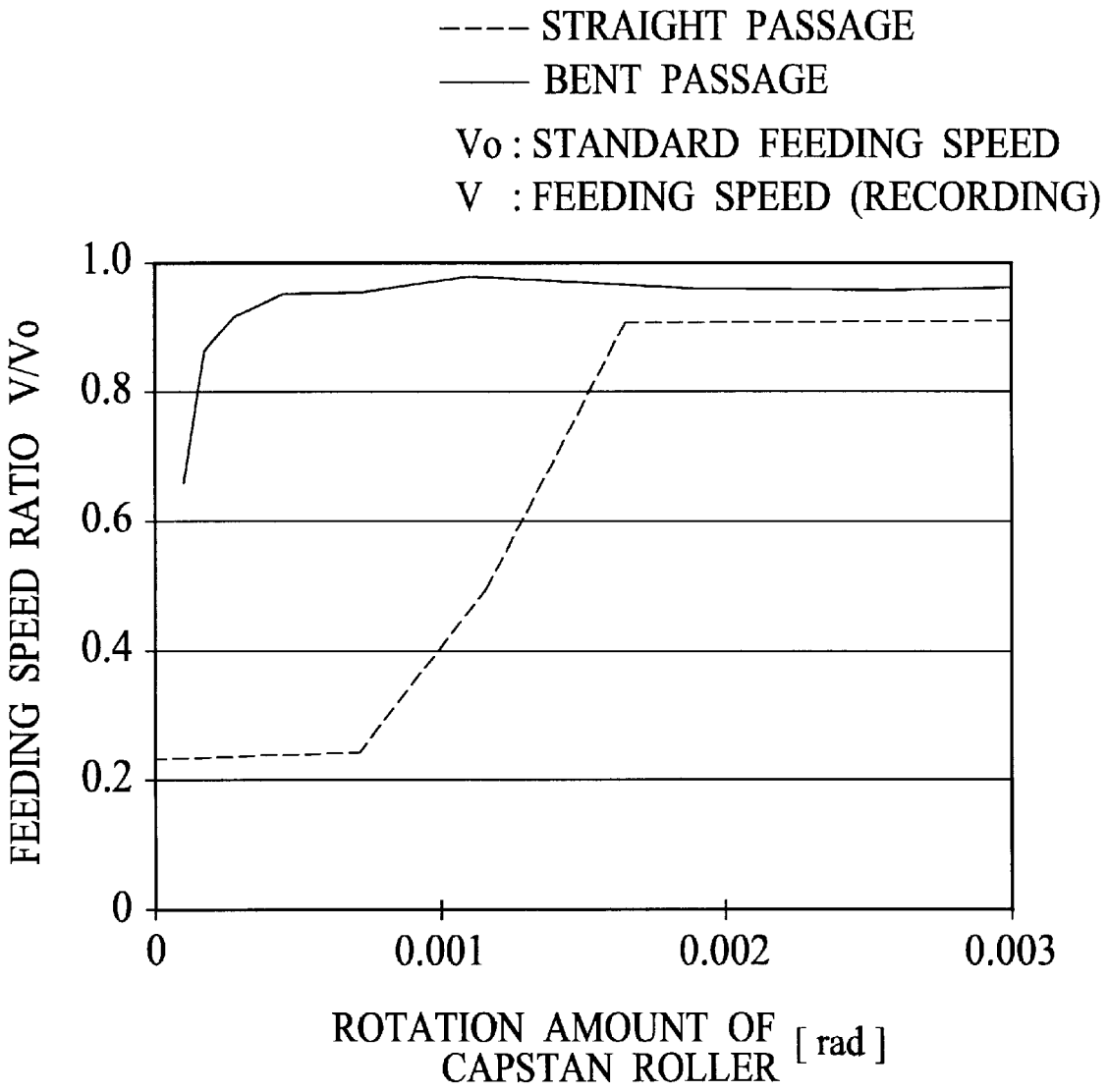
FIG. 6 is a graph showing an initial change of feeding speed.

FIG. 6 shows a graph of feeding speed of the recording sheet 20 just after the capstan roller 25 begins its rotation. As the rotation amount of the capstan roller 25 increases, the feeding speed is risen from an initial feeding speed. When the capstan roller 25 rotates about 0.003 rad, the feeding speed comes up to a normal feeding speed and becomes stable. In this graph, the vertical axis shows the feeding speed ratio V/Vo, and the horizontal axis shows a rotation amount of the capstan roller 25. The feeding speed ratio V/Vo is the same as described above. The ratio of the printer with a bent pass is indicated by a solid line, and that with a conventional straight pass is indicated by a dotted line.

This graph indicates that the printer with bent passage has such a characteristic that the feeding speed is risen to the normal feeding speed faster than that with conventional straight passage. At the normal speed, deviation in feeding speed of the bent passage is less than that of the conventional straight passage. Due to the rapid increase of feeding speed, it is possible to reduce a foremost blank portion without having density unevenness and deviations in recording position.

Figure 7:
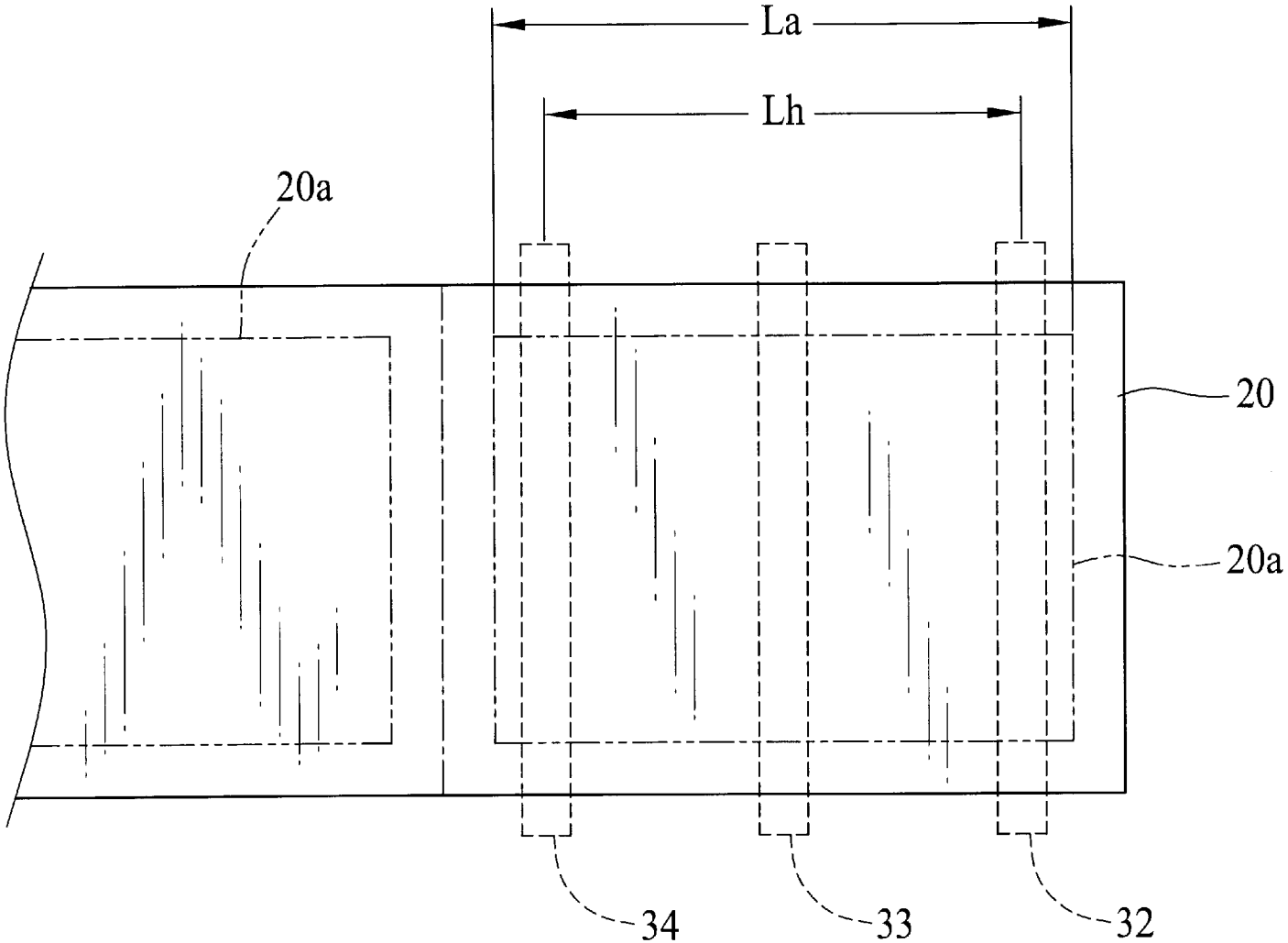
FIG. 7 is a planer view of the recording sheet.

As shown in FIG. 7, the length Lh, that represents the length from the yellow thermal head 32 to the cyan thermal head 34, is shorter than the length La that represents the length of a recording area 20*a* in the advancing direction. This makes the length of the feeding passage 53 short, so recording time can be shortened.

A yellow fixation lamp 45 is provided between the yellow and magenta thermal heads 32 and 33. A magenta fixation lamp 46 is provided between the magenta and cyan thermal heads 33 and 34. The yellow fixation lamp 45 emanates near-ultraviolet rays peaking at the wavelength of 420 nm, for fixing the yellow coloring layer 19 so as not to be colored when heated again. The magenta fixation lamp 46 emanates ultraviolet rays peaking at the wavelength of 365 nm, for fixing the magenta coloring layer 18.

A ejection slit 48 is provided in a position further from the yellow thermal head 32 in the advancing direction. In front of the ejection slit 48 is provided a cutter 49, which includes an upper blade and a lower blade. The cutter 49 is positioned at a print start position. When the front end of the recording sheet 20, fed in the advancing direction, reaches the cutter 49, the recording sheet 20 is fed back to record an image. After recording is completed, the recording sheet 20 is advanced out of the ejection slit 48, and the cutter 49 is actuated to cut the recording sheet 20 into a print.

Figure 8:
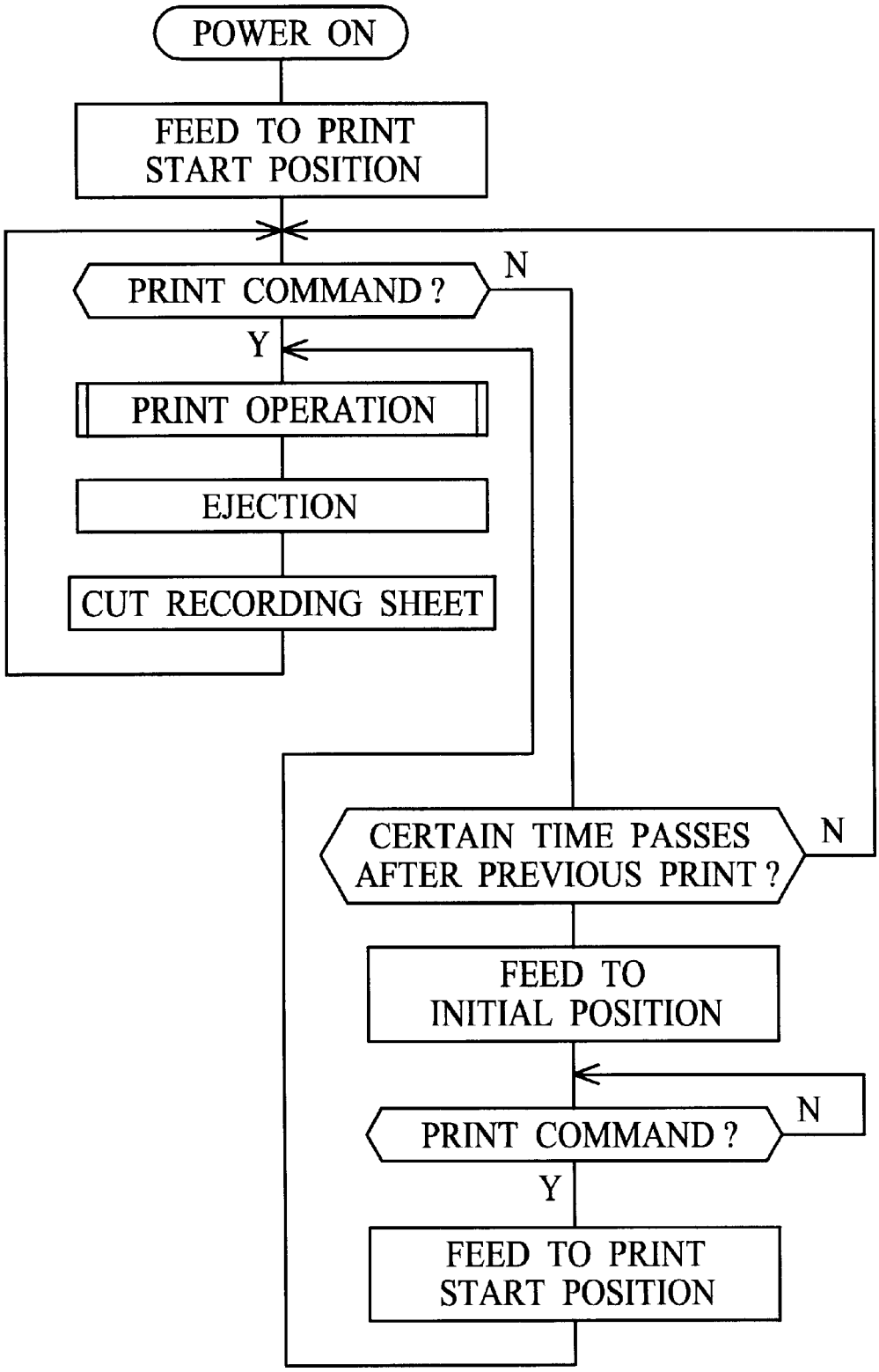
FIG. 8 is a flow chart showing a sequence of operation of the color thermal printer.
Figure 9:
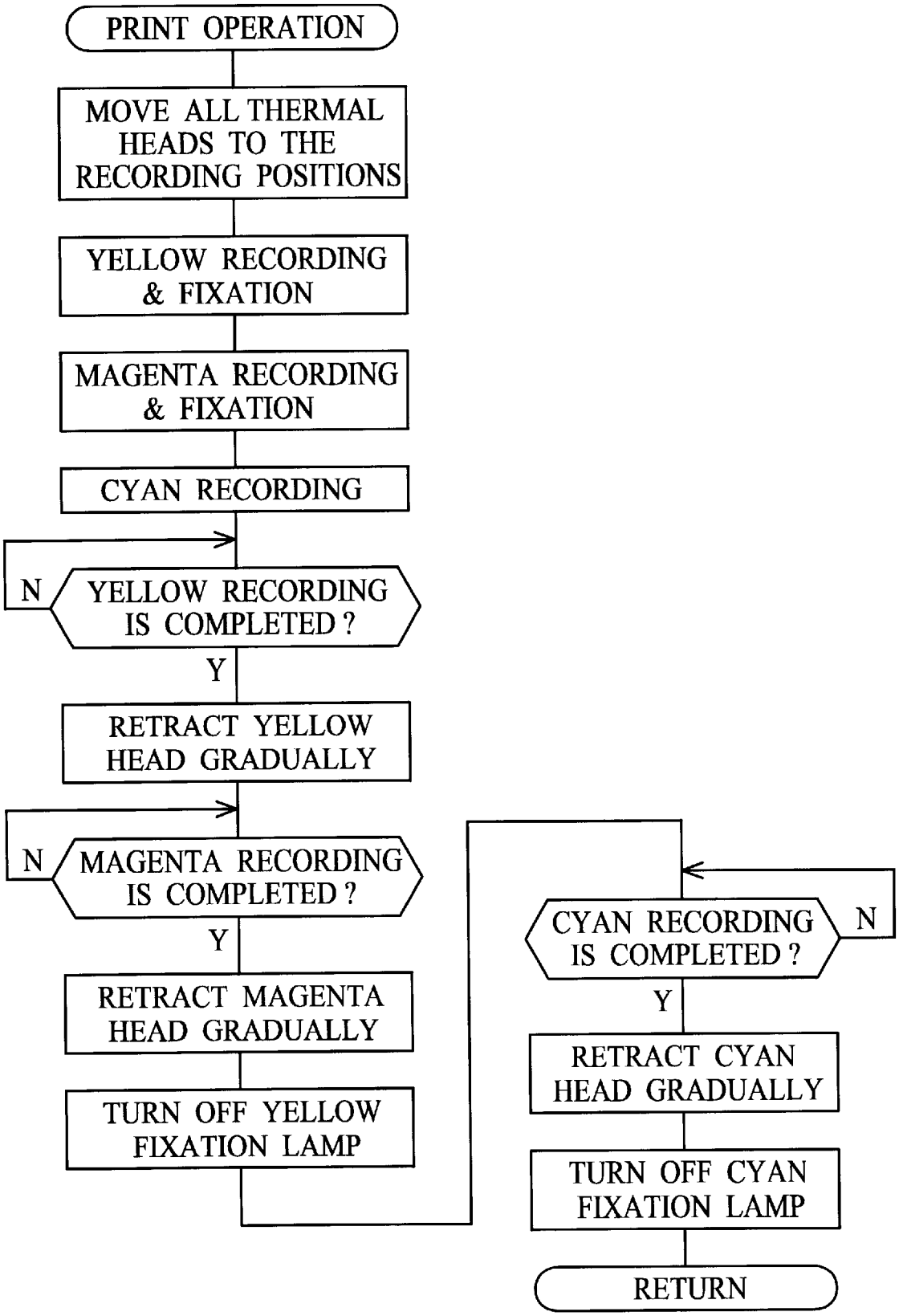
FIG. 9 is a flow chart showing a sequence of print operation.

Next, referring to flow chart shown in FIGS. 8 and 9, operation of the printer having the above described configurations will be described. On powering the color thermal printer, the controller 50 rotates the feeding roller 22 in clockwise direction, so that the recording sheet 20 is pulled into the feeding passage 53 from an initial position where the recording sheet 20 is wound into the recording sheet roll 21. When the front end of the recording sheet 20 passes the conveyor roller set 23, the pinch roller 26, retained in a position away from the capstan roller 25, is released to move downward by a bias of a spring, and presses the recording sheet 20.

The capstan roller 25 rotates in clockwise direction to feed the recording sheet in the advancing direction. When the front end of the recording sheet 20 reaches the print start position to face to the cutter 49, the feeding roller set 24 stops feeding the recording sheet 20. A rotation detector like a photo interrupter is provided in the pinch roller 26, to monitor the feeding amount of the recording sheet 20 by use of the rotation of the pinch roller 26.

If no print command is produced at the time when the recording sheet 20 is located at the print start position, printing operation is not carried out. If print command is not produced for a certain time after the recording sheet 20 is at the print start position, the controller 50 rotates the conveyor roller 22 and the feeding roller set 24 backward to wind the recording sheet 20 to the initial position. Thereby, the recording sheet 20 is protected against light and humidity.

When a print command is produced at the time when the recording sheet 20 is positioned at the print start position, the controller 50 rotates the cams 37 to move the yellow, magenta and cyan thermal heads 32 to 34 to the recording positions. When a print command is produced at the time when the recording sheet 20 is wound into the initial position, the controller 50 rotates the feeding roller 22 and the conveyor roller set 24 to feed the recording sheet 20 to the print start position. Afterwards, the controller 50 rotates the cams 37 to move the yellow, magenta and cyan thermal heads 32 to 34 to the recording positions. These recording heads 32 to 34 contact and press the recording sheet 20 simultaneously.

When respective thermal heads 32 to 34 are moved to the recording positions, the controller 50 drives the conveyor roller set 24 to feed the recording sheet 20 in the recording direction. The feeding speed of the feeding roller 22 is defined to be faster than that of the conveyor roller set 24, so the recording sheet 20 is not loosen in being fed in the recording direction.

When the rear end of the recording area 20*a* reaches the yellow thermal head 32, the yellow thermal head 32 is driven to heat the heating element array 32*a* according to density of yellow image data, so that the yellow image is recorded onto the yellow coloring layer 19. At the same time, the yellow fixation lamp 45 is turned on, and applies near-ultraviolet rays to fix the yellow coloring layer 19.

In recording the yellow image, the rear end of the recording area 20*a* reaches the magenta thermal head 33. Then, the magenta thermal head 33 is driven to heat the heating element array 33*a* according to density of magenta image data, so that the magenta image is recorded onto the magenta coloring layer 18. At the same time, the magenta fixation lamp 46 is turned on, and applies ultraviolet rays to fix the magenta coloring layer 18. When the rear end of the recording area 20*a* reaches the cyan thermal head 34, the cyan thermal head 34 is driven to heat the heating element array 34*a* according to cyan image data, so that the cyan image is recorded onto the cyan coloring layer 17. Thereby, full-color image is recorded in the recording area 20*a*.

As described above, since thermal recording is carried out after all recording heads 32 to 34 moves to the recording positions, the recording sheet 20 is not subjected to rapid change of the load while being fed in the recording direction. Moreover, since the feeding passage 53 has bent portions where the recording sheet 20 is pressed by the pinch roller 26 and the platen rollers 29 to 31, the recording sheet 20 is not waved. Thus, it is possible to decrease deviation in feeding speed.

The recording sheet 20 is fed in the recording direction while the thermal heads 32 to 34 records respective color image. When the yellow image is recorded completely, the controller rotates the cam 37 in the counterclockwise direction. Then, the yellow thermal head 32 moves gradually to the retracted position by the bias of the lifting spring 36. As the cam 37 rotates in the counterclockwise direction, the pressing force of the yellow thermal head 32 decreases gradually. Thus, it is possible to prevent density unevenness and deviation in recording position caused by abrupt change in load to the recording sheet 20.

When the magenta image is recorded completely, the controller rotates the cam 37 in the counterclockwise direction, to move the magenta thermal head 33 to the retracted position gradually. Since the pressing force of the magenta thermal head 33 is decreased gradually, the load to the recording sheet 20 is not changed abruptly. Thus, it is possible to prevent deterioration of print quality. After magenta recording, the recording sheet 20 is not faced to the yellow fixation lamp 45, so the yellow fixation lamp 45 is turned off.

When the cyan image is recorded completely, the cyan thermal head 34 is moved toward the retracted position, decreasing the pressing force to the recording sheet 20 gradually, in the same manner as yellow and magenta recording. After recording cyan image, the recording sheet 20 is not faced to the magenta fixation lamp 46, so the magenta fixation lamp 46 is turned off.

On recording the cyan image completely, the controller stops the conveyor roller set 24 once, and then rotates clockwise to feed the recording sheet 20 in the advancing direction. The front end of the recording sheet 20 is advanced out of the printer through the ejection slit 48. The cutter 49 is actuated to cut the recording sheet 20 such that an user can take a print outside. The front end of the recording sheet 20 is faced to the cutter 49, so it is possible to carry out the next printing operation at once. If the next print command is not produced for a while, the controller 50 drives the feeding roller 22 and the conveyor roller set 24 to wind the recording sheet 20 to the initial position.

The above embodiment is described with a direct type thermal printer, but the present invention is also applicable to thermal transfer type printer with a color ink sheet of yellow, magenta and cyan, such as a sublimation type and a melting type.

The present invention is not to be limited to the above embodiments, but on the contrary, various modifications are possible to those skilled in the art without departing from the scope of claims appended hereto.

What is claimed is:

1. A color thermal printer for recording a full-color image to a recording area of a continuous recording material that is drawn from a roll and fed along a feeding passage, said thermal printer including:

feeding means for feeding said recording material in a first direction and a second direction along said feeding passage, said recording material being fed in said first direction to be drawn from said roll to said feeding passage, said second direction being opposite to said first direction;

a plurality of thermal heads for recording said image in said recording area, said thermal heads being arranged at a regular interval along said feeding passage; and a controller for controlling said feeding means to feed said recording material in said first direction and feed said recording material in said second direction after said recording material reaches a print start position where a rear end of said recording area passes said thermal heads, and driving said thermal heads to record said image in feeding said recording material in said second direction.

2. A thermal printer as claimed in claim 1, wherein said feeding means includes a capstan roller rotated by a motor, and a pinch roller that is pressed to said capstan roller.

3. A thermal printer as claimed in claim 2, wherein said plurality of thermal heads are pressed to said recording material at the same time when said feeding means begins to feed said recording material in said second direction.

4. A color thermal printer for recording a full-color image to a recording area of a continuous recording material that is drawn from a roll, said thermal printer including:

a feeding passage for guiding said recording material from said roll toward an outside of said printer;

feeding means for feeding said recording material in a first direction and a second direction along said feeding passage, said recording material being fed in said first direction to be drawn from said roll to said feeding passage, said second direction being opposite to said first direction;

a plurality of thermal heads for recording said image to said recording area;

a plurality of platens that are disposed opposite to respective said thermal heads; said platens supporting said recording material that is pressed by said thermal heads; and a elastic members for covering surfaces of respective said platens, said elastic members being deformed by pressing force of respective said thermal heads;

wherein said feeding passage is bent toward said thermal heads at positions where said thermal heads press said platens, so as to form V-shapes.

5. A thermal printer as claimed in claim 4, wherein said feeding means is disposed at a position upstream of said thermal heads and comprised of a capstan roller and a pinch roller for nipping and feeding said recording material, a surface of said pinch roller being covered with a elastic material which is deformed by pressing force of said capstan roller, said feeding passage being bent toward said capstan roller at a position where said capstan roller presses said pinch roller, so as to form a V-shape.

6. A thermal printer as claimed in claim 5, wherein said plurality of thermal heads includes a cyan thermal head for recording a cyan image to said recording material, a magenta thermal head that is disposed downstream of said cyan thermal head and records a magenta image, and a yellow thermal head that is disposed downstream of said magenta thermal head and records a yellow image.

7. A thermal printer as claimed in claim 6, further including:

a controller for controlling said feeding means to feed said recording material in said first direction and feed said recording material in said second direction after said recording material reaches a print start position where a rear end of said recording area passes said yellow thermal head, and driving said thermal heads to record said image in feeding said recording material in said second direction.

8. A thermal printer as claimed in claim 7, further comprising:

three head moving mechanism for respective said thermal heads, respective said head moving mechanism moving respective said thermal head between a recording position to press said recording material and a retracted position to be away from said recording material, all said head moving mechanism being driven simultaneously to move said respective thermal head to said recording position when said recording material reaches said print start position, and being driven respectively to move respective said thermal heads to said retracted positions when respective said thermal heads complete recording of respective color images.

9. A thermal printer as claimed in claim 8, wherein said head moving mechanism moves said thermal head gradually from said recording position to said retracted position such that pressing force of said thermal head is decreased gradually.

10. A thermal printer as claimed in claim 9, wherein said head moving mechanism includes:

a spring for biasing said thermal head toward said retracted position; and a cam that is disposed in rotatable fashion and has a cam edge of roughly circular shape, one distal end of said thermal head being adapted to said cam edge, radius of said cam edge about a shaft thereof being changed gradually, said thermal head moving gradually as said cam rotates.

11. A thermal printer as claimed in claim 10, wherein a distance between said yellow thermal head and said magenta thermal head being shorter than a length of said recording area.

12. A thermal printer as claimed in claim 11, further including:

a cutter for cutting recorded said recording material by a certain length, said cutter being disposed at a position to which a front end of said recording material, which is located at said print start position, is faced.

* * * * *